US005677655A

United States Patent [19]

Hinata et al.

[11] Patent Number: 5,677,655

[45] Date of Patent: Oct. 14, 1997

[54] ELECTROMAGNETIC CONTACTOR WITH ADJUSTMENT CONTACT TERMINALS

[75] Inventors: Masamitsu Hinata; Kouetsu Takaya, both of Saitama, Japan

[73] Assignee: Fuji Electric Co., Ltd., Kawasaki, Japan

[21] Appl. No.: 509,646

[22] Filed: Jul. 31, 1995

[30] Foreign Application Priority Data

Aug. 9, 1994 [JP] Japan ..... 6-208050

[51] Int. Cl.[6] ..... H01H 67/02

[52] U.S. Cl. ..... 335/132; 335/202

[58] Field of Search ..... 335/132, 202; 200/295–309

[56] References Cited

U.S. PATENT DOCUMENTS 4,184,134 1/1980 Kane et al. ..... 335/132

4,539,541 9/1985 Bharteey et al. ..... 335/198

*Primary Examiner*—Lincoln Donovan

*Attorney, Agent, or Firm*—Kanesaka & Takeuchi

[57] ABSTRACT

A general purpose electromagnetic contactor that can be easily mounted on a printed circuit board. A general purpose electromagnetic contactor includes main terminals and auxiliary contact terminals, and connecting faces of the main terminals and connecting faces of the auxiliary contact terminals are positioned at different levels or planes. Adjustment terminals are connected to the auxiliary contact terminals to position the connecting faces of the adjustment terminals in the same level as the connecting faces of the main terminals. Therefore, the general purpose electromagnetic contactor can be mounted on a printed circuit board.

9 Claims, 3 Drawing Sheets

ELECTROMAGNETIC CONTACTOR WITH ADJUSTMENT CONTACT TERMINALS

BACKGROUND OF THE INVENTION AND RELATED ART STATEMENT

The present invention relates to electromagnetic contactors, and more specifically, the present invention relates to an improvement of auxiliary contact terminals for mounting a general purpose electromagnetic contactor on a printed circuit board.

Electromagnetic contactors mounted on a printed circuit board are disclosed in Japanese Utility Model Publication (KOKOKU) No. H02-12670 and in Japanese Patent Publication (KOKAI) No. H01-281632. In these electromagnetic contactors, main terminals and coil terminals are provided to be led to the top surface of the electromagnetic contactor. And, the connecting faces of the main and coil terminals are arranged on the same plane. This type of the electromagnetic contactor is also disclosed in Japanese Utility Model Publication (KOKAI) No. S61-149253.

As the current capacity that a printed circuit board can carry increases, the rated current of the electromagnetic contactors mounted on the printed circuit boards has also increased from the conventional 30 A or less to 50–60 A, and further to 100A. However, needs for the large electromagnetic contactors to be mounted on the printed circuit boards are fewer than needs for the small electromagnetic contactors. Therefore, it is not economical to make and store the large electromagnetic contactors with the structures proposed by the above identified patent publications, i.e., structures exclusive for mounting the small electromagnetic contactors on printed circuit boards.

Moreover, many electromagnetic contactors are provided with auxiliary contacts which link with main contacts for linkage with other control circuit parts or for interlocking. However, in the electromagnetic contactors of the above identified patent publications, it is difficult to arrange the auxiliary contact terminals together with the main and coil terminals on the top surface of the electromagnetic contactor while establishing sufficient insulation distances among the main and coil terminals and the auxiliary contact terminals, because the space at the top surface of the electromagnetic contactor is not sufficient.

In view of the foregoing, it is an object of the present invention to provide an electromagnetic contactor for mounting a printed circuit board which includes auxiliary contacts and can be manufactured at low cost and even at small-quantity production.

SUMMARY OF THE INVENTION

The above object is achieved by utilizing a general electromagnetic contactor, which comprises main terminals, auxiliary contact terminals having connecting faces positioned at different height or level from connecting faces of the main terminals, and adjustment terminals for adjustment the height of the connecting faces of the auxiliary contact terminals. The adjustment terminals are connected to the auxiliary contact terminals to position the connecting faces of the auxiliary contact terminals in substantially the same level as the connecting faces of the main terminals.

One type of the electromagnetic contactors houses auxiliary contact terminals in a side part of a frame of the electromagnetic contactor. Another type of the electromagnetic contactors has an auxiliary contact unit mounted on a side part of the frame of the electromagnetic contactor in addition to or in place of the built-in auxiliary contact terminals. A still another type of the electromagnetic contactors has an auxiliary contact unit mounted on a top of a frame of the electromagnetic contactor. Usually, the connecting faces of the built-in auxiliary contact terminals or those of the auxiliary contact terminals of the auxiliary contact unit mounted on the side part of the frame are positioned lower than the connecting faces of the main terminals. Or, in the electromagnetic contactor having the auxiliary contact unit mounted on the top of the electromagnetic contactor, the connecting faces of the auxiliary contact terminals are positioned higher than the contacting faces of the main terminals.

Briefly stated, the present invention provides an electromagnetic contactor with auxiliary contact terminals built in the frame of the electromagnetic contactor, having adjustment terminals each being formed of a flat rectangular conductor plate and bent at its both ends at right angles so as to form a terminal end and a connecting end spaced from one another by the height difference between the main and auxiliary contact terminals. The connecting end of the adjustment terminal is placed on the connecting face of the auxiliary contact terminal to level the terminal end of the adjustment terminal with the connecting face of the main terminal at the same height. In this case, the electromagnetic contactor is provided with a terminal cover which comprises recesses for accepting the terminal ends of the adjustment terminals and slits for accepting neck parts adjoining the terminal ends of the adjustment terminals. The terminal cover is fitted to the adjustment terminal from the side thereof to cover a charging part of the adjustment terminal, and fixed to the frame of the electromagnetic contactor by means of hooks.

The present invention also provides an electromagnetic contactor with at least one auxiliary contact terminal unit mounted on the side of the frame of the electromagnetic contactor, and adjustment terminals, in which the connecting faces of auxiliary contact terminals disposed in the auxiliary contact terminal unit are positioned lower than the connecting faces of the main terminals. Each of the adjustment terminals is formed of a flat rectangular conductor plate, and both ends of the adjustment terminal are bent at right angles so as to form a terminal end and a connecting end spaced from one another by the height difference between the main and auxiliary contact terminals. Each connecting end of the adjustment terminal is placed on the connecting face of the auxiliary contact terminal to position the terminal end of the adjustment terminal in substantially the same level as in the connecting faces of the main terminal.

In this embodiment, the electromagnetic contactor is also provided with at least one terminal cover comprising recesses for accepting the terminal ends of the adjustment terminals and slits for accepting the neck parts adjoining the terminal ends of the adjustment terminals. The terminal cover is fitted to the adjustment terminals from the side thereof to cover a charging part of the adjustment terminal, and fixed to a case of the auxiliary contact terminal unit by means of hooks.

The present invention further provides an electromagnetic contactor having an auxiliary contact terminal unit mounted on a top of the frame of the electromagnetic contactor, in which the connecting faces of auxiliary contact terminals disposed in the auxiliary contact terminal unit are positioned higher than the connecting faces of main terminals. The contactor includes adjustment terminals, wherein an upper part of each adjustment terminal is bent at right angle to form a connecting end, and a lower part of each adjustment terminal extended obliquely towards the frame of the electromagnetic contactor. Each connecting end of the adjustment terminal is placed on the connecting face of the auxiliary contact terminal to position the opposite end of the auxiliary contact terminal in substantially the same level as in the connecting faces of the main terminal.

In any of the aforementioned embodiments of the present invention, when moving contacts of the auxiliary contacts are removed, and the auxiliary contact terminals are connected to coil terminals with conductors, so that the connecting faces of the coil terminals can be positioned in the same level with the connecting faces of the main terminals.

In the general purpose electromagnetic contactors, the auxiliary contacts are housed inside the electromagnetic contactors, or mounted on the side or on the top of the electromagnetic contactor as a separately structured auxiliary contact unit. Generally, in the general purpose electromagnetic contactors, each connecting face of the auxiliary contact is positioned at a different level from the connecting face of the main contact.

Thus, it is impossible to connect the auxiliary contacts to a printed circuit board together with the main contacts without employing additional means. The present invention adopts adjustment terminals as the additional means. The adjustment terminals are connected to the auxiliary contact terminals to position the terminal ends of the adjustment terminals in substantially the same level as the connecting faces of the main terminals. Thus, the connecting faces of the auxiliary contact terminals are substantially brought to the same height with the connecting faces of the main terminals.

Further, in the present invention, moving contacts of the auxiliary contacts with the adjustment terminals may be removed to abandon the function of the auxiliary contacts, and the auxiliary contact terminals may be instead connected to coil terminals. As a result, the connecting faces of the coil terminals may be positioned in the same level as the connecting faces of the main terminals. Since the general purpose electromagnetic contactors are usually provided with plural poles of the auxiliary contacts, some of the auxiliary contact poles may be abandoned without problems for the sake of coil terminal connection.

DETAILED DESCRIPTION OF THE PREFERRED EMBODIMENT

The present invention will be explained hereinafter with reference to the accompanied drawings of FIGS. 1 through 10, which illustrate the preferred embodiments of the present invention.

Figure 1:
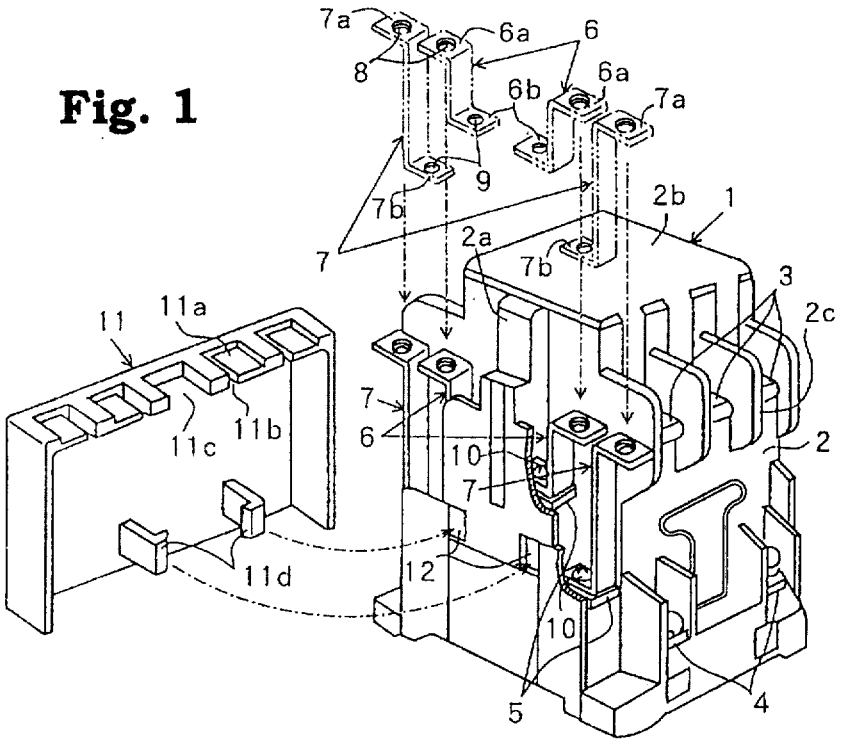
FIG. 1 is an exploded perspective view of a first embodiment of an electromagnetic contactor of the present invention.
Figure 2:
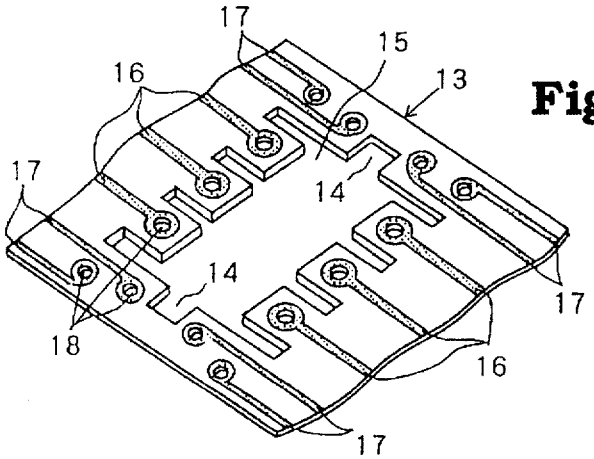
FIG. 2 is a perspective view showing a back surface of a printed circuit board in the first embodiment.
Figure 3:
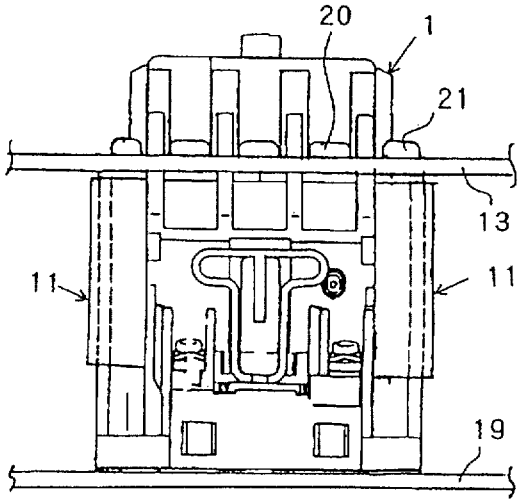
FIG. 3 is a front view of the electromagnetic contactor of FIG. 1 mounted the printed circuit board in the first embodiment.

FIGS. 1 through 3 show a first embodiment of an electromagnetic contactor which incorporates auxiliary contacts in its main body. FIG. 1 is an exploded perspective view of the first embodiment. FIG. 2 is a perspective view showing a main back surface of a printed circuit board. And, FIG. 3 is a front view of an electromagnetic contactor mounted on a printed circuit board.

Referring now to FIG. 1, an electromagnetic contactor 1 has a structure known to one skilled in the art. The electromagnetic contactor 1 has a frame 2 having a structure divided into an upper part and a lower part. The frame 2 houses a switch which comprises a moving contact supported by a contact support which links with a moving core of an actuating electromagnet, and a stationary contact fixed to the frame 2. Main terminals 3 are divided to locate at the front and rear sides of the frame 2, i.e. at a power supply side and a load side respectively, and arranged on the upper part of the frame 2. Coil terminals 4 are arranged at the power supply side on the lower part of the frame 2.

Auxiliary contact terminals 5 for two poles are respectively arranged on right and left sides of the frame 2. On each side of the frame 2, two inner terminals 5 and two outer terminals 5 in the front and back portions respectively form pairs. The pair of the inner auxiliary contact terminals is positioned higher than the pair of the outer auxiliary contact terminals. When the auxiliary contacts of the inner auxiliary contact terminals 5 are designated as a contacts (normally open contacts), and the auxiliary contacts of the outer auxiliary contact terminals 5 are designated as b contacts (normally closed contacts), the auxiliary contacts are formed of two poles of the a contacts and two poles of the b contacts, that is a *2a2b* contact structure. In the thus electromagnetic contactor, the connecting faces, i.e. upper surfaces, of the auxiliary contact terminals 5 and the connecting faces, i.e. upper surfaces, of the coil terminals 4 are positioned lower than the connecting faces of the main terminals 3. Therefore, it is impossible to connect integrally the main terminals 3, auxiliary contact terminals 5 and coil terminals 4 to a printed circuit board, as they are.

To avoid this problem, adjustment terminals 6 and 7 are connected to the auxiliary contact terminals 5. Each of the adjustment terminals 6 and 7 is made of a flat rectangular conductor with the same width as that of the auxiliary contact terminal 5. Both ends of the adjustment terminal 6 are bent at right angles in opposite directions to form a terminal end *6a* and a connecting end *6b*. Also, both ends of the adjustment terminal 7 are bent at right angles in opposite directions to form a terminal end *7a* and connecting end *7b*. Screw holes 8 are formed through the terminal ends *6a*, *7a*, and clamping holes 9 are formed through the connecting ends *6b*, *7b*. A pair of front and rear adjustment terminals 6 is positioned between a pair of front and rear adjustment terminals 7. Therefore, the pair of adjustment terminals 6 is defined as an inner pair of adjustment terminals, and the pair of adjustment terminals 7 is defined as an outer pair of adjustment terminals. Each inner adjustment terminal 6 is shorter than each outer adjustment terminal 7 by a gap of the auxiliary contact terminal 5.

These adjustment terminals 6 and 7 are inserted into the electromagnetic contactor 1 as indicated by single-dotted chain lines until the connecting ends 6b and 7b are superposed on the auxiliary contact terminals 5. The connecting ends 6b, 7b are fixed to the auxiliary contact terminals 5 by screwing screws 10 through the clamping holes 9 into screw holes of the auxiliary contact terminals 5. The connecting faces of the terminal ends 6a, 7a of the adjustment terminals 6, 7 thus fixed to the auxiliary contact terminals 5 are positioned at the same level as the connecting faces of the main terminals 3.

A terminal cover 11 is fixed to the electromagnetic contactor 1 having the adjustment terminals 6, 7 connected thereto. The terminal cover 11 is shaped into a shape illustrated in the figure by resin molding. Recesses 11a are formed on the upper part of the terminal cover 11 for receiving the terminal ends 6a, 7a of the adjustment terminals 6, 7. A slit 11b is disposed in each recess 11a, wherein each neck part of the adjustment terminals 6, 7 immediately below the terminal end 6a, 7a is inserted into the slit 11b. A cut-out 11c is formed on the upper part of the terminal cover 11 for avoiding interference with a protrtrusion 2a formed on the side face of the frame 2.

A pair of hooks 11d is unitarily formed with the terminal cover 11 on its inside front face. In a way as illustrated by the single-dotted chain curve arrows in FIG. 1, the hooks 11d couple with rims of two square holes 12 opened on the side face of the frame 2. The holes 12 in the frame 2 may be used to mount an auxiliary contact unit as described later in a second embodiment. The terminal cover 11 is pushed laterally to the electromagnetic contactor 1 to couple with the frame 2 by the hooks 11d, and engages the adjustment terminals 6, 7 through the slits 11b. The terminal cover 11 covers the charging-up part of the adjustment terminals 6, 7, and operates to fix or hold the upper parts of the adjustment terminals 6, 7 through the recesses 11aand the slits 11b.

Referring now to FIG. 2, a printed circuit board 13 comprises a base plate having cut-outs 14 for accepting the protrusions 2a of the frame 2, and a comb-tooth like window 15 for accepting a head 2b and inter-phase separation walls 2c. Main circuit conductor patterns 16 and auxiliary conductor patterns 17 are formed on the base plate corresponding to the main terminals 3 and the adjustment terminals 6, 7. A fixing hole 18 is opened in a terminal part of each conductor pattern.

Referring now to FIG. 3, the printed circuit board 13 is slid downward from the top of the electromagnetic contactor 1 to be fitted around the electromagnetic contactor 1 mounted on an adaptor plate 19 such as a switchboard. The printed circuit board 13 is fixed to the electromagnetic contactor 1 by screwing main terminal screws 20 through the fixing holes 18 into screw holes of the main terminals 3, and by also screwing auxiliary terminal screws 21 through the fixing holes 18 into the screw holes 8 of the adjustment terminals 6, 7. The terminal cover 11 fitted to the neck parts of the adjustment terminals 6 and 7 prevents the adjustment terminals 6, 7 from rotating upon screwing the auxiliary terminal screws 21.

Figure 4:
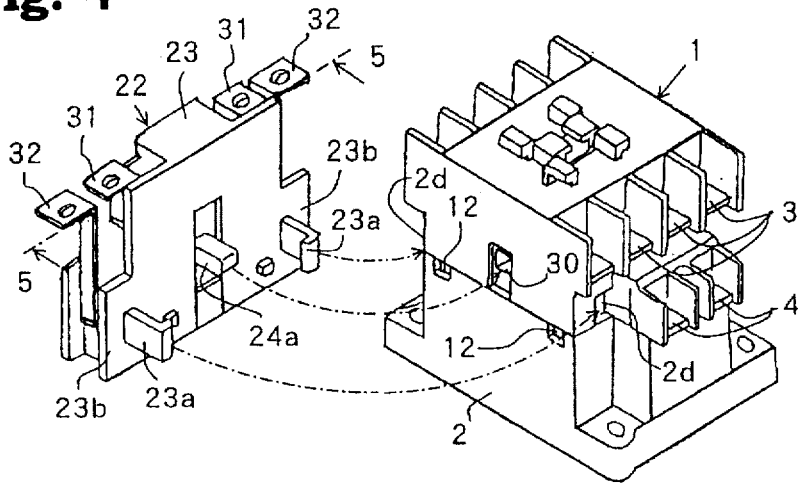
FIG. 4 is an exploded perspective view of a second embodiment of the electromagnetic contactor.
Figure 5:
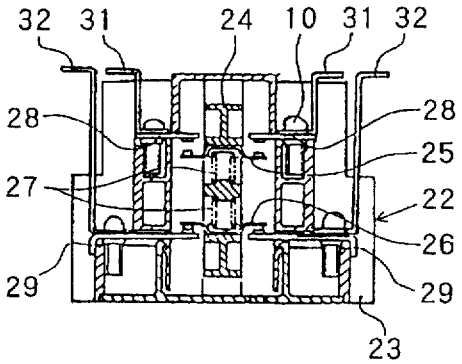
FIG. 5 is a sectional view taken along a line 5—5 in FIG. 4.
Figure 6:
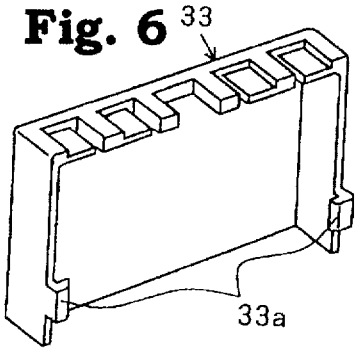
FIG. 6 is a perspective view of a terminal cover of FIG. 4.

FIGS. 4–6 show a second embodiment of the electromagnetic contactor in which an auxiliary contact unit is mounted on the side face of the frame. FIG. 4 is an exploded perspective view of the second embodiment. FIG. 5 is a sectional view taken along a line 5—5 of FIG. 4. And, FIG. 6 is a perspective view of a terminal cover of the second embodiment.

Referring now to FIGS. 4 and 5, an auxiliary contact unit 22 has a case 23. An auxiliary contact support 24 is vertically slidably inserted in the case 23. A moving contact 25 is held together with a contact spring 27 in an upper window hole of the auxiliary contact support 24. A moving contact 26 is held together with another contact spring 27 in a lower window hole of the auxiliary contact support 24. An auxiliary contact terminal 28 is unitarily formed with a stationary contact, and an auxiliary contact terminal 29 is unitarily formed with a stationary contact. A pair of the front and rear auxiliary contact terminals 28 is fixed to the case 23 to be opposed to the moving contact 25, and also a pair of the front and rear auxiliary contact terminals 29 is fixed to the case 23 to be opposed to the moving contact 26. As shown in FIG. 5, when the auxiliary contact unit 22 is removed from the electromagnetic contactor 1, the upper moving contact 25 is separated from the stationary contacts and the lower moving contact 26 contacts the stationary contacts. When the auxiliary contact unit 22 is mounted on the electromagnetic contactor 1, however, the auxiliary contact support 24 is lifted upwards to allow the upper moving contact 25 to the b or closed contact, and the lower moving contact 26 to the a or open contact. Thus, the auxiliary contact unit 22 shown in the figures has an 1a1b contact structure.

As shown by the single-dotted chain curve arrows in FIG. 4, the auxiliary contact unit 22 is mounted on the electromagnetic contactor 1 by hooks 23a unitarily formed with the case 23 corresponding to the recesses 2d formed on the front and rear parts of the frame 2. At the same time, the auxiliary contact unit 22 is linked with the electromagnetic contactor 1 by inserting a link protrusion 24a of the contact support 24 into a link hole 30 of a main contact support disposed inside the electromagnetic contactor 1.

Also, in this embodiment, adjustment terminals 31 and 32 are fixed by the screws 10 to level the connecting faces of the auxiliary contact terminals 28 and 29 at the same height with the connecting faces of the main terminals 3. Then, a terminal cover 33 is mounted on the case 23. The structures of the adjustment terminals 31, 32 and the terminal cover 33 are the same as those shown FIG. 1, so that the explanation is omitted here. In the second embodiment, however, the terminal cover 33 is fitted to the case 23 by coupling the hooks 33a, which are disposed on both sides of the terminal cover 33, with both sides 23b of the case 23 shown in FIG. 4. When the auxiliary contact units 22 are mounted on the right and left sides of the electromagnetic contactor 1, a structure of a printed circuit board for the second embodiment is the same as that of the printed circuit board 13 of FIG. 1. Therefore, the printed circuit board for the second embodiment is not illustrated here.

Figure 7:
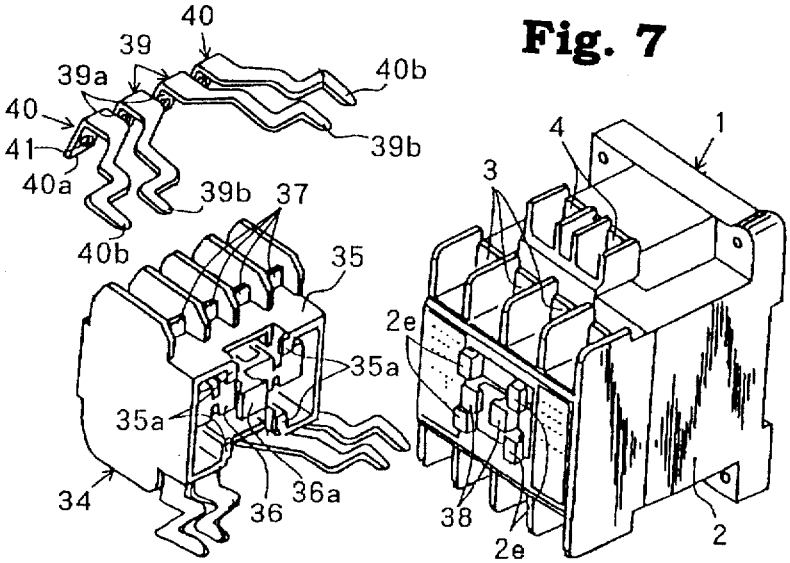
FIG. 7 is an exploded perspective view of a third embodiment of the electromagnetic contactor.
Figure 8:
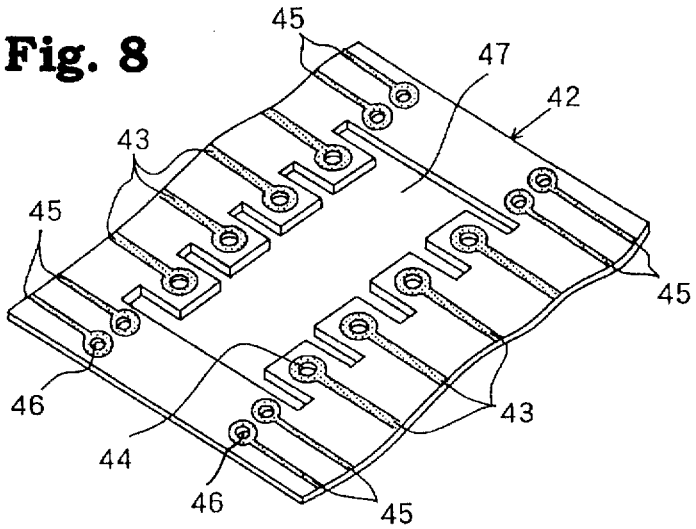
FIG. 8 is a perspective view of a printed circuit board in the third embodiment.
Figure 9:
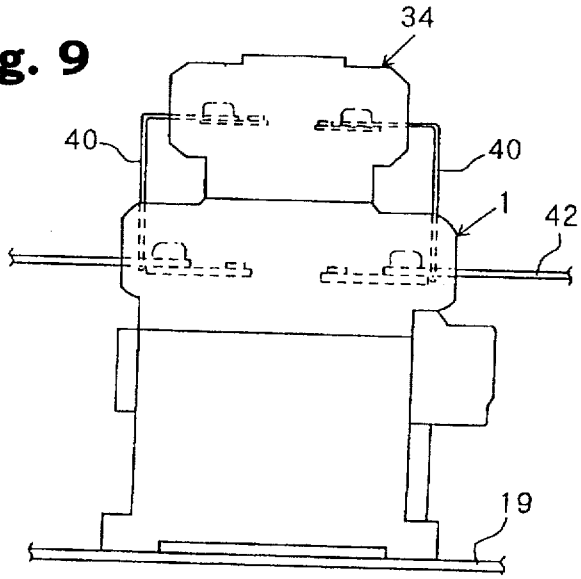
FIG. 9 is a side view of the electromagnetic contactor of FIG. 7 with the printed circuit board in the third embodiment.
Figure 10:
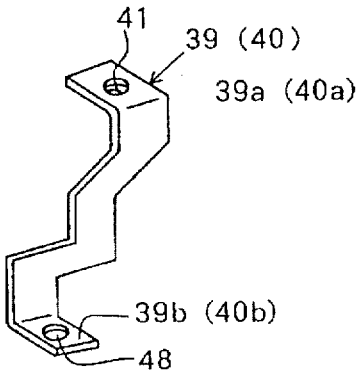
FIG. 10 is a perspective view of another example of an adjustment terminal of FIG. 7.

FIGS. 7–10 show a third embodiment of the electromagnetic contactor, in which an auxiliary contact unit is mounted on a top of a frame. FIG. 7 is an exploded perspective view of the third embodiment. FIG. 8 is a perspective view of a back surface of a printed circuit board. FIG. 9 is a side view of the electromagnetic contactor mounted on the printed circuit board. And, FIG. 10 is a perspective view of another example of the adjustment terminal.

Referring now to FIG. 7, an auxiliary contact unit 34 has four poles. Moving contacts (not shown) are held by an auxiliary contact support 36 slidably vertically inserted in a case 35. Front and rear pairs of auxiliary contact terminals 37 are fixed to the case 35, and each auxiliary contact terminal 37 is formed unitarily with a stationary contact to be opposed to the moving contact. Hooks 35a are disposed on a bottom side of the case 35 in the auxiliary contact unit 34, and hooks 2e are disposed on the upper side of the frame 2 in the electromagnetic contactor 1. The auxiliary contact unit 34 is fitted to the electromagnetic contactor 1 by coupling the hooks 35*a* with the hooks 2*e*. At the same time, the auxiliary contact unit 34 is linked with the electromagnetic contactor 1 bycoupling a link protrusion 36*a*, of the contact support 36 with hooks 38 of a main contact support disposed inside the electromagnetic contactor 1. In the auxiliary contact unit 34 mounted on the electromagnetic contactor 1 as described above, connecting faces of the auxiliary contact terminals 37 are positioned higher than connecting faces of the main terminals 3.

Therefore, adjustment terminals 39, 40 are connected to the auxiliary contact terminals 37. The adjustment terminals 39, 40 are respectively made of a conductor plate stamped out in an S-shape directing laterally. Connecting parts 39*a*, 40*a* are respectively formed by bending the upper ends of the adjustment terminals 39, 40 at right angles, and the lower ends of the adjustment terminals 39, 40 are shaped like rods to form terminal ends 39*b* and 40*b*. Inner two poles, i.e. the adjustment terminals 39, are arranged symmetrically to one another, and outer two poles, i.e. the adjustment terminals 40, bending more widely than the inner poles 39 are arranged symmetrically to one another. The connecting parts 39*a*, 40*a* are fixed to the auxiliary contact terminals 37 with screws (not shown) through fixing holes 41 so as to fix the adjustment terminals 39, 40 to the auxiliary contact terminals 37. The adjustment terminals 39, 40 fixed to the auxiliary contact terminals 37 extend slantingly downwards toward the lateral side of the frame 2 so as to level the terminal ends 39*b* and 40*b* at the same height with the connecting faces of the main terminals 3.

Referring now to FIG. 8, fixing holes 44, through which terminal screws are inserted, are disposed at the ends of main circuit conductor patterns 43 formed on a printed circuit board 42. On both sides of the printed circuit board, plural sets of two poles of auxiliary contact circuit conductor patterns 45 are respectively formed outside outer contact circuit conductor patterns 43 in order to correspond to the adjustment terminals 39 and 40, and connecting holes 46 are disposed at the ends of the auxiliary contact circuit conductor patterns 45 so as to receive the terminal ends 39*b* and 40*b*. The printed circuit board 42 is fitted to the electromagnetic contactor 1 through a window hole 47 of the printed circuit board 42 in the same manner as shown in FIG. 2. The printed circuit board 42 is connected to the main terminals 3 with screws (not shown). Then, the terminal ends 39*b* and 40*b* of the adjustment terminals 39, 40 are inserted into the connecting holes 46 and soldered. Thus, the auxiliary contact unit 34, the printed circuit board 42 and the electromagnetic contactor 1 are assembled as shown in FIG. 9.

In FIG. 9, each of the adjustment terminals 39 and 40 is formed with a rod shape so that the adjustment terminals 39 and 40 are inserted into the connecting holes 46 and soldered to the printed circuit board 42. When the adjustment terminals 39 and 40 are designed to be connected to terminal screws, the terminal ends 39*b* and 40*b* may be bent as shown in FIG. 10 to have fixing holes 48 disposed at the terminal ends 39*b* and 40*b*. In this case, the terminal ends of the auxiliary contact conductor patterns are printed on a face opposed to the face of the printed circuit board on which the main circuit conductor patterns are printed.

Throughout the embodiments described above, if connecting faces of the coil terminals 4 in the electromagnetic contactor are leveled with the main terminals 3, moving contacts are removed from the auxiliary contact supports, and the auxiliary contact terminals, from which the moving contact are removed, are connected to the coil terminals with lead wires, conductor plates and etc. In the second embodiment, for example, the lower moving contacts 26 of the auxiliary contact terminal unit 22 of FIG. 5 are removed to abandon the a contact function, and the auxiliary contact terminals 29, from which the lower moving contacts 26 are removed, are connected to the coil terminals 4 with lead wires. Thus, the outer adjustment terminals 32 function as the coil terminals, and the connecting faces of the outer adjustment terminals 32 are positioned in the same level as the connecting faces of the main terminals 3.

As explained above, in the present invention, since the adjustment terminals are connected to the auxiliary contact terminals to locate the connecting faces of the adjustment terminals in the same level as the connecting faces of the main terminals, the present invention facilitates obtaining electromagnetic contactors with auxiliary contacts mountable on a printed circuit board by using general purpose electromagnetic contactors. The present invention also facilitates mounting a large capacity electromagnetic contactor on a printed circuit board at low cost. As a modification of the present invention, if the moving contacts of the auxiliary contacts are removed, and the auxiliary contact terminals are connected to the coil terminals, it is possible to connect the coil terminals with a printed circuit board via the adjustment terminals.

What is claimed is:

1. An electromagnetic contactor comprising:

a plurality of main terminals having first connecting faces located in a first plane;

a plurality of auxiliary terminals having second connecting faces located in a plane different from the first plane; and a plurality of adjustment terminals connected to the auxiliary terminals, each adjustment terminal being formed of a flat conductor plate and having a connecting end and a terminal end at both ends thereof, said adjustment terminals having lengths such that when the connecting ends of the adjustment terminals are fixed to the auxiliary terminals, the adjustment terminals are located substantially in the first plane of the first connecting faces.

2. An electromagnetic contactor according to claim 1, further comprising a frame having said second connecting faces at one side thereof.

3. An electromagnetic contactor according to claim 2, further comprising at least one terminal cover attached to the frame for covering the second connecting faces and parts of the adjustment terminals, said terminal cover having a plurality of recesses for receiving the terminal ends therein, slits for allowing the conductor plates to pass therethrough, and hooks engaging said frame.

4. An electromagnetic contactor according to claim 1, further comprising a frame having the main terminals, and at least one auxiliary contact terminal unit attached to a lateral side of the frame and having said auxiliary contact terminals therein and said adjustment terminals.

5. An electromagnetic contactor according to claim 4, further comprising at least one terminal cover attached to the auxiliary contact terminal unit for covering the second connecting faces and the adjustment terminals, said terminal cover having a plurality of recesses for receiving the terminal ends therein, slits for allowing the conductor plates to pass therethrough, and hooks engaging said auxiliary contact terminal unit.

6. An electromagnetic contactor according to claim 1, further comprising a frame having the main terminals, and an auxiliary contact terminal unit situated on the frame and having said auxiliary contact terminals and said adjustment terminals connected thereto.

7. An electromagnetic contactor according to claim 1, further comprising a plurality of coil terminals disposed in a frame, said coil terminals being connected to the auxiliary terminals with conductors.

8. An electromagnetic contactor according to claim 1, further comprising a printing circuit board, said main terminals and said terminal ends of the adjustment terminals being connected to the printing circuit board.

9. An electromagnetic contactor according to claim 1, further comprising a plurality of coil terminals, said coil terminals being connected to the adjustment terminals.

* * * * *

UNITED STATES PATENT AND TRADEMARK OFFICE

CERTIFICATE OF CORRECTION

PATENT NO. : 5,677,655

DATED : October 14, 1997

INVENTOR(S) : Masamitsu Hinata; Kouetsu Takaya

It is certified that error appears in the above-indentified patent and that said Letters Patent is hereby corrected as shown below:

In column 1, line 57, change "adjustment" to --adjusting--;

In column 3, line 10, delete "so that";
line 52, after "mounted" add --on--;

In column 4, line 6, change "accompanied" to --accompanying--;

In column 5, line 21, change "protrtrusion" to --protrusion--;

In column 6, line 19, change "25 to" to --25 to become--;
line 20, change "26 to" to --26 to become--;

In column 7, line 3, change "bycoupling" to --by coupling--, and "36a," to --36a--; and
line 35, change "outer contact" to --the main--.

Signed and Sealed this

Twentieth Day of January, 1998

*Attest:*

BRUCE LEHMAN

*Attesting Officer*

*Commissioner of Patents and Trademarks*